US012790107B2

(12) United States Patent
Nabeiro et al.

(10) Patent No.: US 12,790,107 B2
(45) Date of Patent: Nov. 10, 2026

(54) CAPSULE OF COMPOSITE MATERIAL AND STRUCTURAL CONFIGURATION OF REINFORCED BASE

(71) Applicant: NOVADELTA—COMÉRCIO E INDÚSTRIA DE CAFÉS, LDA, Lisbon (PT)

(72) Inventors: Rui Miguel Nabeiro, Campo Maior (PT); João André De Figueiredo Branco, Moscavide (PT); Marco Filipe Goncalves Martins, Pedreiras Pedreiras (PT)

(73) Assignee: NOVADELTA—COMÉRCIO E INDÚSTRIA DE CAFÉS, LDA, Lisbon (PT)

( * ) Notice: Subject to any disclaimer, the term of this patent is extended or adjusted under 35 U.S.C. 154(b) by 1368 days.

(21) Appl. No.: 17/429,135

(22) PCT Filed: Feb. 6, 2020

(86) PCT No.: PCT/PT2020/050004
§ 371 (c)(1),
(2) Date: Aug. 6, 2021

(87) PCT Pub. No.: WO2020/162775
PCT Pub. Date: Aug. 13, 2020

(65) Prior Publication Data

US 2022/0048700 A1 Feb. 17, 2022

(30) Foreign Application Priority Data

Feb. 8, 2019 (PT) ..... 115299

(51) Int. Cl.
*B65D 85/804* (2006.01)
*B65D 65/46* (2006.01)

(52) U.S. Cl.
CPC ..... *B65D 85/8043* (2013.01); *B65D 65/466* (2013.01)

(58) Field of Classification Search
CPC ..... A23F 3/06; A23F 5/10; A23F 5/24; A47J 31/0673; A47J 31/0642; A47J 31/0689; A47J 31/3676
(Continued)

(56) References Cited

U.S. PATENT DOCUMENTS 10,159,375 B2 12/2018 Rapparini
2007/0181005 A1 8/2007 Kirschner et al.
(Continued)

FOREIGN PATENT DOCUMENTS

EP 1 992 575 A1 11/2008
EP 2 218 653 A1 8/2010
(Continued)

OTHER PUBLICATIONS

Robert Masirek et al., "Composites of Poly(L-lactide) with Hemp Fibers: Morphology and Thermal and Mechanical Properties", Journal of Applied Polymer Science, Jul. 5, 2007, pp. 255-268, vol. 105, No. 1.
(Continued)

*Primary Examiner* — Chris Q Liu
(74) *Attorney, Agent, or Firm* — Sughrue Mion, PLLC

(57) ABSTRACT

A capsule (1) in a composite material, the capsule (1) being adapted for containing an edible substance, such as for example roasted ground coffee beans, and for being flow through by a pressurized flow with a flow pressure bigger than 4 bar, preferentially bigger than 8 bar. The capsule (1) presents a container part (11) that is provided in a composite material that includes polymers associated with natural
(Continued)

vegetable substances, and that is configured so as to resist to internal pressures of at least 4 bar, preferentially of at least 8 bar.

11 Claims, 6 Drawing Sheets

(58) Field of Classification Search
USPC ..... 99/295
See application file for complete search history.

(56) References Cited

U.S. PATENT DOCUMENTS

| | | | |
|---|---|---|---|
| 2012/0097602 | A1 | 4/2012 | Tedford |
| 2018/0178972 | A1 | 6/2018 | Mondillon et al. |

FOREIGN PATENT DOCUMENTS

| | | | |
|---|---|---|---|
| EP | 1 961 676 | B1 | 4/2011 |
| EP | 1 807 318 | B1 | 9/2012 |
| EP | 2 408 691 | B1 | 7/2013 |
| EP | 3 044 124 | A1 | 7/2016 |
| EP | 3 045 406 | A1 | 7/2016 |
| FR | 3 035 085 | A1 | 10/2016 |
| IT | MI20 082 282 | A1 | 6/2010 |
| IT | BO20 120 314 | A1 | 12/2013 |
| WO | 03/000810 | A1 | 1/2003 |
| WO | 2012/077066 | A1 | 6/2012 |
| WO | 2013/131117 | A1 | 9/2013 |
| WO | 2015/121489 | A1 | 8/2015 |
| WO | 2015/145361 | A1 | 10/2015 |
| WO | 2015/162632 | A1 | 10/2015 |
| WO | 2018/050544 | A1 | 3/2018 |

OTHER PUBLICATIONS

Soo Hyun Sung et al., "Development of polylactic acid nanocomposite films reinforced with cellulose nanocrystals derived from coffee silverskin", Carbohydrate Polymers, Aug. 2017, pp. 495-503, vol. 169.

International Search Report of PCT/PT2020/050004 dated Jun. 18, 2020 [PCT/ISA/210].

Written Opinion of PCT/PT2020/050004 dated Jun. 18, 2020 [PCT/ISA/237].

CAPSULE OF COMPOSITE MATERIAL AND STRUCTURAL CONFIGURATION OF REINFORCED BASE

CROSS REFERENCE TO RELATED APPLICATIONS

This application is a National Stage of International Application No. PCT/PT2020/050004, filed Feb. 6, 2020, claiming priority to Portuguese Patent Application No. 115299, filed Feb. 8, 2019.

FIELD OF THE INVENTION

The present invention refers to the field of capsules for preparing beverages and produced in a composite material comprising a non-synthetic substance, in general, and that besides present a reinforced structural configuration, in particular.

BACKGROUND OF THE INVENTION

The prior art includes several documents related with capsules for preparing beverages by means of mixture of an edible substance inside thereof with a pressurized flow, and disclosing solutions for reinforcing the structural capacity of said capsules, in particular in case the capsule is produced in a synthetic material including bio-polymers or other substances with viability of composting by natural means, as substitutes of the usual synthetic materials of fossil origin. In particular, in certain capsules, the base wall of a container part is the flow exit surface and the one submitted to a greater hydraulic pressure and, therefore, structural solicitation.

The document EP 1807318 B1 discloses a capsule of the type of the present invention comprising a container part that presents ribs on the sidewall and ribs on the base wall. The ribs on the sidewall seem to have an increasing thickness towards the perimeter of the sidewall.

The document EP 1961676 B1 discloses a capsule whereby the base wall presents a wall portion of bigger wall thickness than a central region, relative to the remaining base wall, whereby this wall portion extends on the downstream-oriented side, such as a plurality of ribs.

The document EP 2408691 B1 discloses a capsule whereby the container part is made of a bio-degradable polymer and whereby the base wall presents a plurality of elements in a radial disposition and a plurality of flow passageways in the cavity spaces conformed between said radial elements, whereby said passageways are not aligned with said radial elements.

The document WO 2015/145361 A1 discloses a capsule whereby the base wall presents a portion of convex surface provided on the downstream-oriented surface and that extends with a thickness that decreases towards the edge of its convexity.

The prior art further includes several documents relating to composite substances presenting a composition that includes synthetic polymers, notably in a thermoplastic matrix, and bio-polymers.

The document EP 22218653 A1 discloses a biologically decomposable capsule that includes a shell, a layer of fibre and a closure membrane that are in each case constituted by a biologically decomposable material.

The document WO 03/000810 A1 discloses an improved composition of impregnation and coating based upon emulsions of polymers and latex of vegetal origin such as shell and other ashes, including ash of coffee shell.

The document WO 2012/077066 A1 discloses a capsule for preparing a liquid product comprising a base wall that presents a structure in layers with at least one layer made of a first compostable material and at least a layer made of a second compostable material that does not endure a noticeable softening and/or melting at a temperature of 70° C.-120° C. In particular, said first compostable material is selected from the group that includes polymers derived from biomasses, synthetic polymers, polymers produced by microorganisms or genetically modified bacteria, polymers of fossil monomers, and mixtures of said polymers with or without additives. Said second compostable material is selected from paper, such as cellulose paper and, preferentially 100% of cellulose paper, cardboard, cellophane paper and cellulose acetate, in particular, the layer of said first material is disposed internally in relation to the layer of said second material. The disclosed capsule can be integrally constituted by compostable material. This document describes definitions of "compostable" and of "bio-degradability", both of which are in the scope of the present application.

The document US 2012/0097602 A1 discloses a capsule of similar type, whereby the filter component presents a mixture of to 60% of cellulose fibres and of about 40 to 100 of compostable polyester fibres.

The document WO 2015/121489 A1 discloses a capsule of similar type that comprises a bio-degradable and compostable polymer material, or a mixture of said materials, and a percentage of filling agents, whereby the polymer materials include agro-polymers and bio-polyesters.

The document WO 2015/162632 A1 discloses a compound with a thermoplastic polymer and a filling means for producing food packages, in particular coffee capsule, and that also includes polysaccharides derived from agro-polymers. Said capsule presents a single layer and is made from a material comprising a bio-degradable and compostable polymer, with a percentage of filling means between 15% and 80% of at least one aliphatic polyester or aromatic-aliphatic containing from 15% to 90% of one or more filling means with a D50 granulometry.

The document FR 3035085 also discloses a capsule produced from a compound including agro-polymers from a particular list of possible origins of such agro-polymers.

The documents WO 2013/131117 A1 and WO 2018/050544 A1 also disclose capsules of the type of the present invention, with reinforcement means of sidewall and of part of the upstream wall.

The use of this type of materials comprising bio-polymers presents, however, two main constrains with relation to the usual synthetic materials of fossil origin: a substantial increase of the material cost per quantity unit thereof, and a reduction of structural resistance, that on its turn contributes to aggravate the cost of package.

None of the documents in the prior art discloses a composite substance presenting a structural configuration that provides an optimization of the structural resistance and, therefore, of the quantity of material used.

GENERAL DESCRIPTION OF THE INVENTION

The objective of the present invention is to provide a capsule for preparation of beverages by means of injection of a pressurized flow at a flow pressure of at least 8 bar, and provided in a composite substance comprising bio-polymers, said capsule being configured so that presents better structural resistance, including in the base wall of the container part.

This objective is solved according to the present invention by means of a capsule according to claim 1, whereby preferred embodiments are disclosed in the dependent claims.

An associated objective is to provide a flow exit disposition through the base wall of the container part that provides a better distribution of the hydraulic pressure and load losses at the beverage flow exit, thereby contributing to reduce the needs of structural reinforcement of the base wall.

Another associated objective is to provide a composite substance presenting a composition that includes synthetic polymers and bio-polymers, in particular using fibres of natural materials instead of biodegradable plastic materials, in particular at least comprising one bio-polymer of vegetable origin and adapted so that provides thermal, mechanical, fluid transport (permeability) and surface transport properties (wettability, friction coefficient), and other properties, advantageous in view of several uses and with reduction of costs.

In particular, the capsule is produced in a material that comprises between 60 and 90% of a material associated with at least one of: sugarcane, cassava and corn, whereby the remaining composition includes the PLA polymer, or similar.

In particular, the capsule according to the present invention is produced in a composite substance that includes coffee silverskin fibre in its composition, whereby said composite substance does not include PLA.

Said composite substance can include at least one of:

a polyethylene from the list that includes high density polyethylenes and low density polyethylenes (LDPE), polycaprolactone (PCL);

thermoplastic amid (TPS);

copolymer of ethylene vinyl alcohol (EVOH);

polyvinylidene chloride (PVDC), and a compatibilization agent.

Said composite substance can include a polyethylene grafted with maleic anhydride (PE-co-MA) as compatibility agent.

DESCRIPTION OF THE FIGURES

The invention shall be hereinafter explained in greater detail based upon preferred embodiments and the attached Figures.

The Figures show, in simplified schematic representations.

DETAILED DESCRIPTION OF PREFERRED EMBODIMENTS OF THE INVENTION

Figure 1:
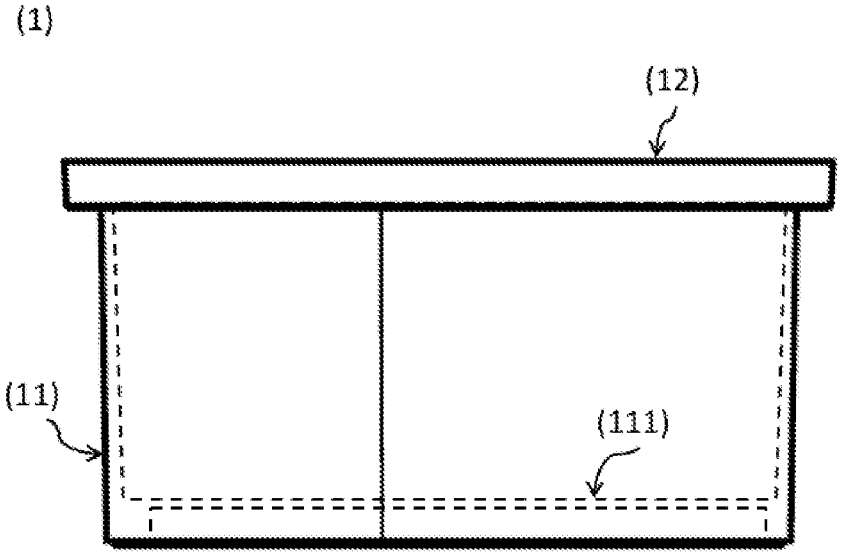
FIG. 1: side view of an embodiment of capsule of the type of the present invention.
Figure 2:
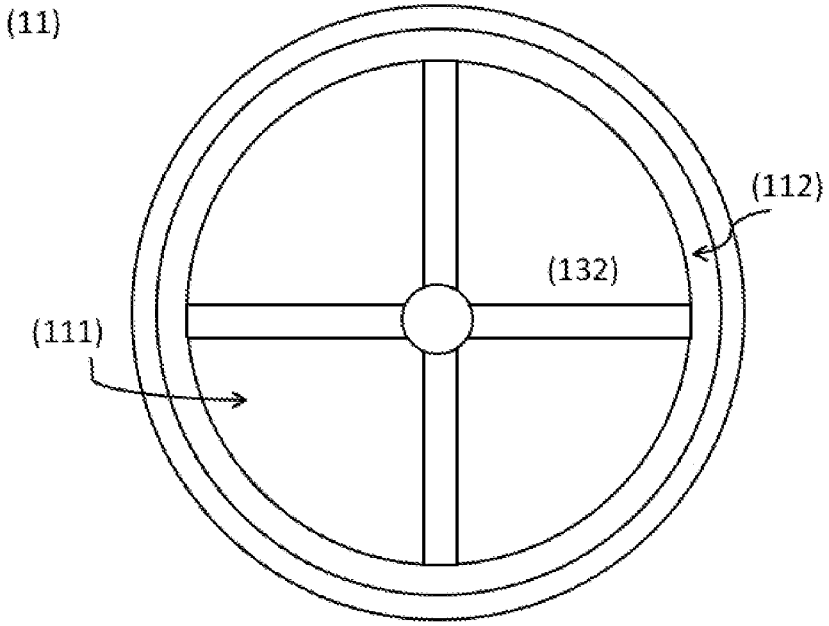
FIG. 2: top view of an embodiment of capsule (1)

Capsules of the type of the present invention are used in machines for preparing beverages by means of injection of a pressurized flow at a flow pressure of at least 8 bar, sometimes of more than 15 bar, and basically comprise a container part (11) and a lid part (12) adapted so that can close the previous one (see FIGS. 1 and 2). Said pressurized flow is made to enter into the capsule through the lid part (12) and exit through the base wall (111) of the container part. The container part (11) presents a base wall (111) and a sidewall (112), for example of cylindrical shape, extending in symmetric manner with relation to a central axis (x) of the capsule. The capsule can be provided in a synthetic material comprising bio-polymers, in general, so as to mitigate the associated environmental impact. In the particular case where said base wall (111) is also the beverage exit wall, then it is also it that is submitted to bigger structural requirements, as a result from the hydraulic pressure upstream thereof.

The capsule can present structural reinforcement means with the shape of ribs, adapted so as to structurally reinforce the side and base walls thereof. The base wall (111) can present base reinforcement ribs (131), and the sidewall (112) can present side reinforcement ribs (132).

Figure 3:
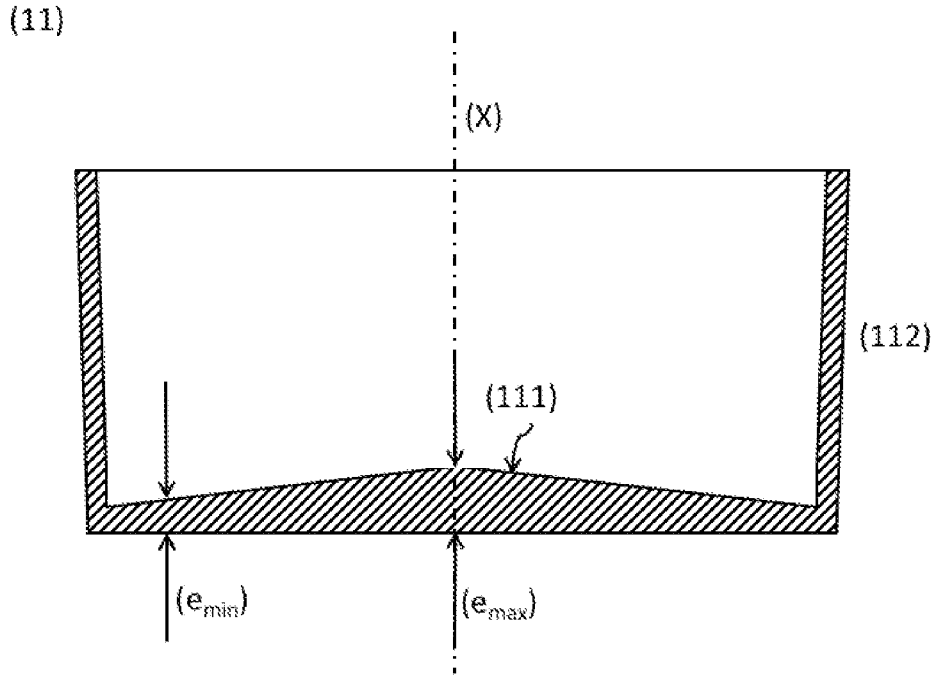
FIG. 3: side-cut view of an embodiment of a capsule (1) according to the present invention.

As depicted in representative schematic view FIG. 3, a capsule (1) according to the present invention comprises a container part (11) whereby the base wall (111) presents a wall thickness that increases towards the centre thereof, and of at least approximately symmetric shape with relation to said central axis (X) and in at least approximately uniform manner all around thereof.

In particular, it has been demonstrated as sufficient, at least for a given range of operation flow pressures, when said increase of wall thickness of the base wall (111) is only provided in the upstream-oriented face thereof, so that the downstream-oriented face retains a planar form devoid of cavities or projections at least in the central region thereof.

Figure 4:
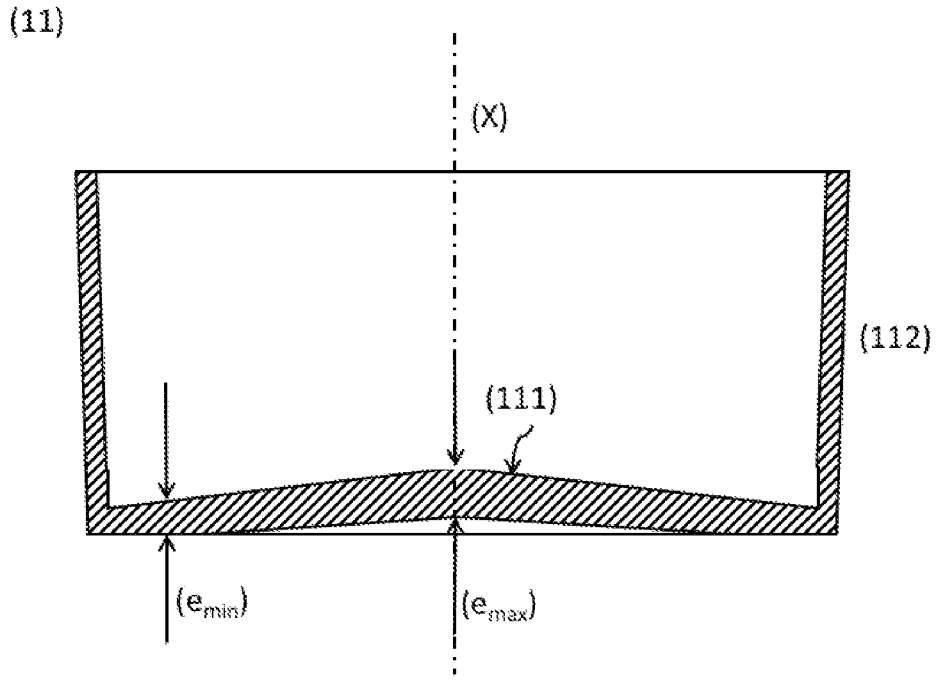
FIG. 4: side-cut view of an embodiment of a capsule (1) according to the present invention.

The base wall (111) can present, in general, a convex shape extending upstream, including with increase of the wall thickness towards the central region thereof (see FIG. 4).

As the applicant was able to experimentally demonstrate, said configurations of the base wall (111) provide a substantial increase of structural resistance of the base wall (111), in particular in the central region thereof.

It is preferred when said increase of wall thickness of the base wall (111) unfolds at least on a central region thereof, for example on a central region that extends in a radial extension corresponding to 20 up to 50% of the free interior dimension of said base wall (111).

It is preferred when said increase of the wall thickness of the base wall (111) unfolds in at least approximately continuous manner.

Figure 5:
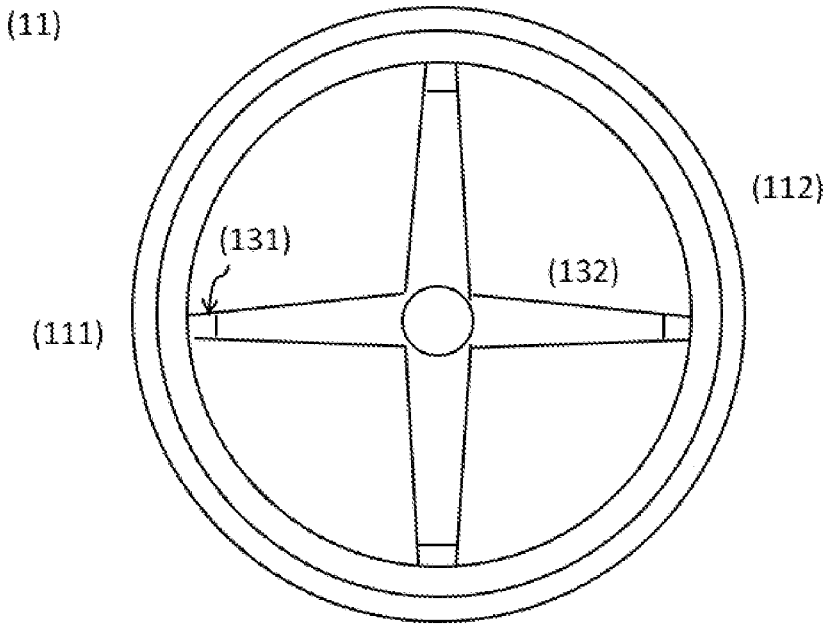
FIG. 5: top view of an embodiment of a container part (11) of a capsule according to the present invention.
Figure 6:
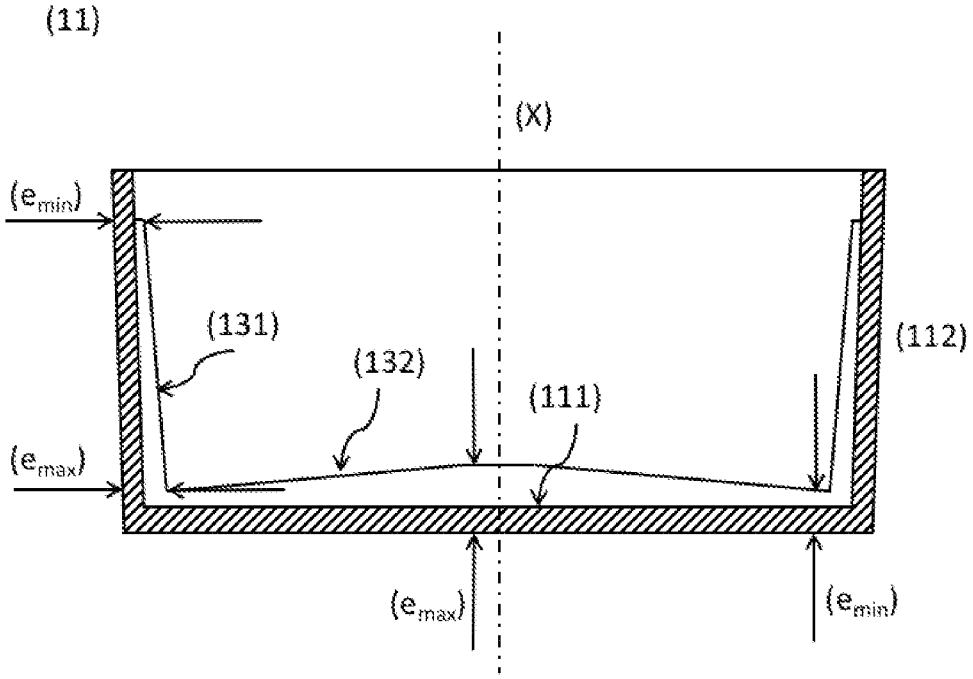
FIG. 6: side-cut view of an embodiment of a container part (11) of a capsule (1) according to the present invention.
Figure 7:
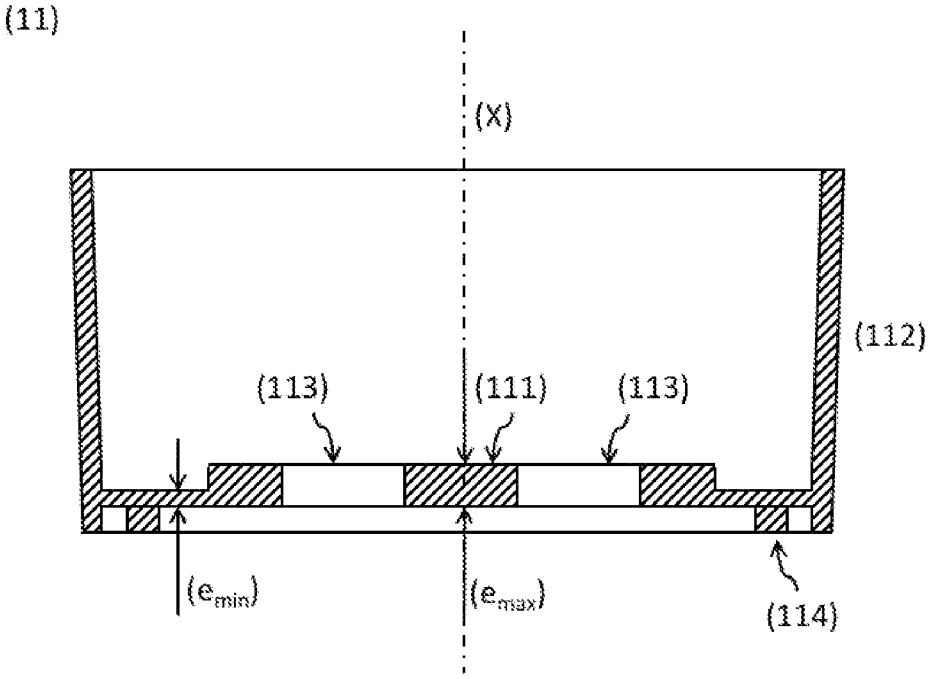
FIG. 7: side-cut view of an embodiment of a container part (11) of a capsule (1) according to the present invention.
Figure 8:
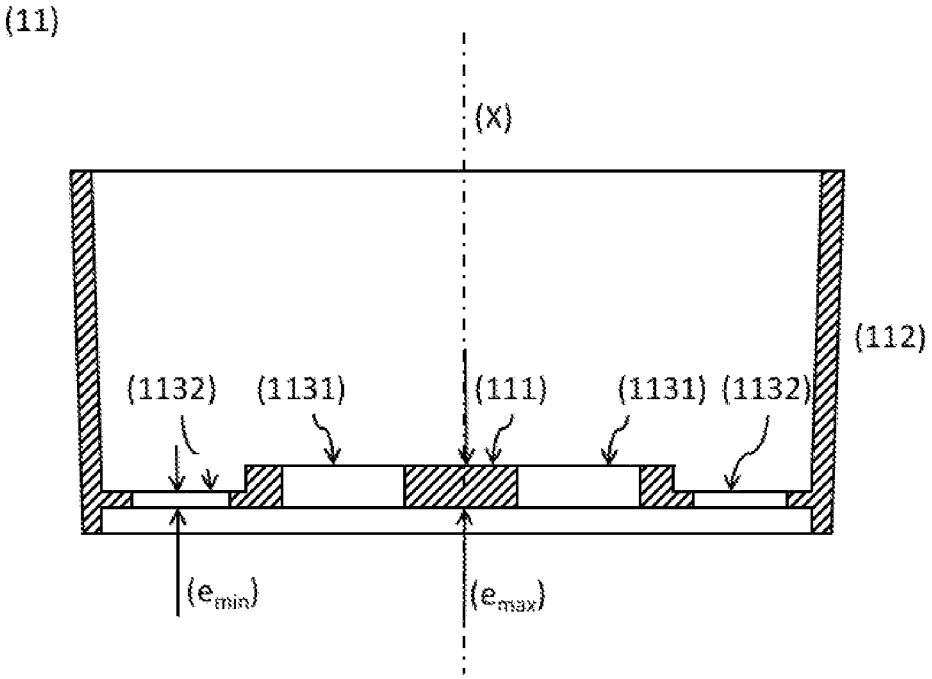
FIG. 8: side-cut view of an embodiment of a container part (11) of a capsule (1) according to the present invention.
Figure 9:
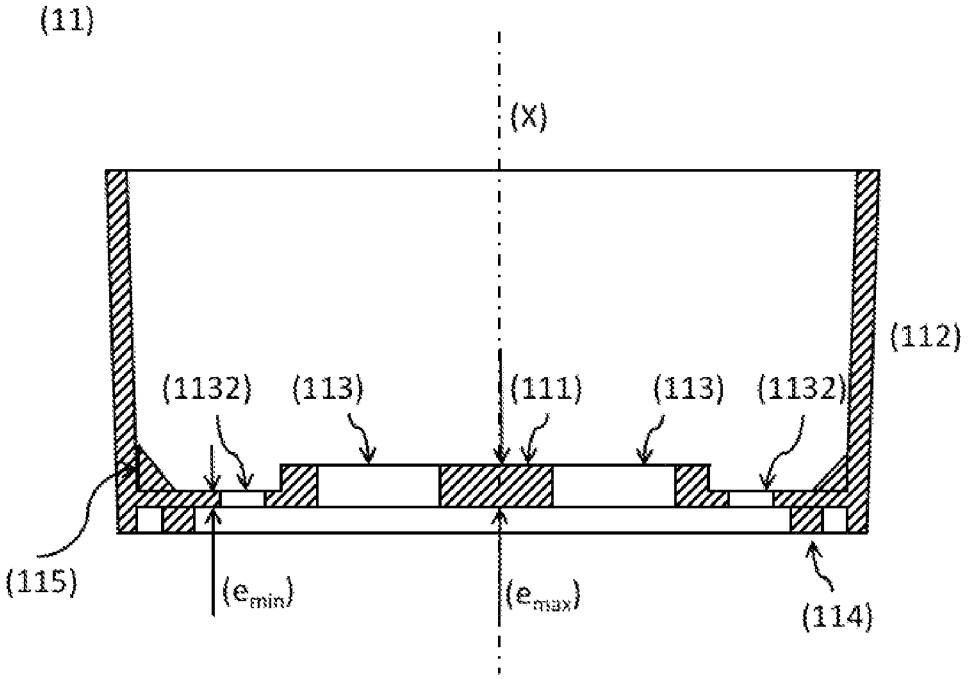
FIG. 9: side-cut view of an embodiment of a container part (11) of a capsule (1) according to the present invention.
Figure 10:
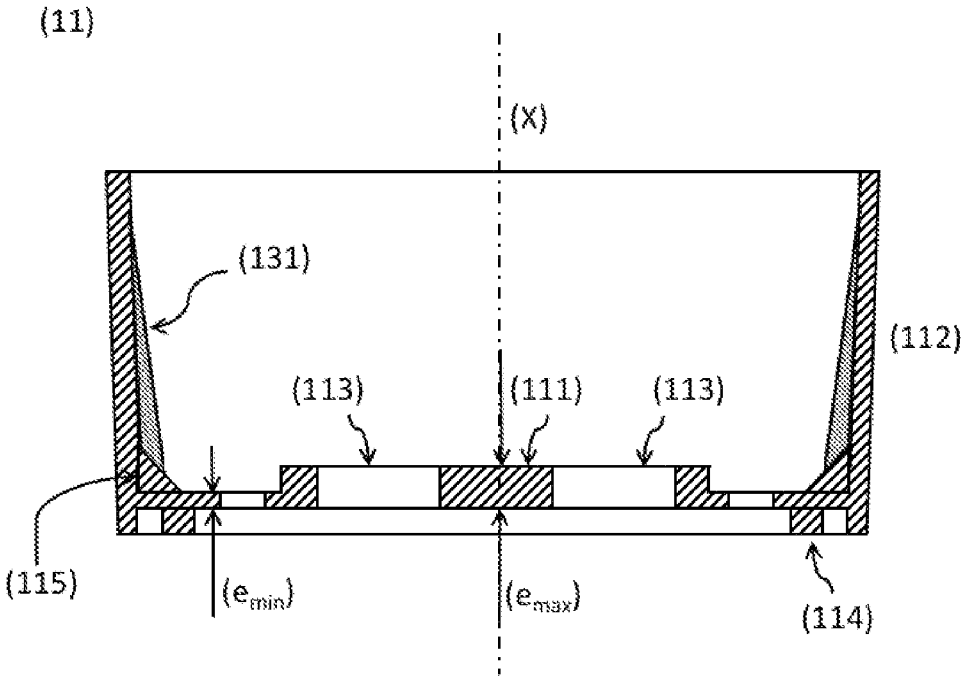
FIG. 10: side-cut view of an embodiment of a container part (11) of a capsule (1) according to the present invention.

The capsule (1) according to the present invention, as represented in FIGS. 5 and 6, is characterized in that presents a container part (11) that presents reinforcement means including:

lateral reinforcement means (131) configured so that present an increase of thickness of the sidewall (112) towards said base wall (111), and base reinforcement means (132) that present an increase of wall thickness of the base wall (111) towards the centre of said base wall (111), whereby said reinforcement means (131, 132) are provided as ribs that extend in the interior surface of the container part (11), so that provide a localized increase of the wall thickness of said container part (11), said increase of wall thickness generally extending in the downstream direction and towards the centre thereof.

It is herewith advantageously provided a solution that avoids a generalized increase of wall thickness of said structural reinforcement means, notably by reinforcement means, for example of ribs type, with an uniform thickness along its extension, but rather there is provided a gradual increase of thickness of said reinforcement means, and thereby of structural reinforcement of said base wall (111) and sidewall (112) of the container part (11), at measure with the requirements of the pressurized flow inside the capsule (1) during the beverage preparation process.

As represented, said container part (11) can comprise lateral reinforcement ribs (131) provided as ribs that extend on the interior face of the sidewall (12) along the prevailing flow direction and that present an increase of wall thickness towards the base wall (111), whereby said increase of wall thickness extends in at least one of, preferentially both of, the circular and radial directions of said lateral reinforcement ribs (131), with relation to the central axis (X).

Moreover, said container part (11) can comprise base reinforcement ribs (132) that extend in a radial configuration on the base wall (111) of the container part (11), and that present an increase of wall thickness along the radial direction, preferentially continuous and gradual, in the direction of the central region of the base wall (111).

It is particularly preferred in a capsule (1) according to the present invention, when at least part of, preferentially all, of said first and second reinforcement ribs (131, 132) extend in aligned manner relative to each other, preferentially extend continuously between each other, so that provide an increase at least approximately continuous of the wall thickness of the container part (11) along the sidewall (12) and until the central region of the base wall (111).

As shall be readily understood by an expert in the field, the aforementioned described configuration of the structural reinforcement ribs, extending continuously along at least part of the sidewall (112) and base wall (111), and with a gradual and continuous increase of dimension in at least one, preferentially in both the radial and angular directions, in the direction of the central region of said base wall (111), provides an optimized structural reinforcement in view of the prevailing requirements during the process of extraction of a beverage under pressure.

Figure 11:
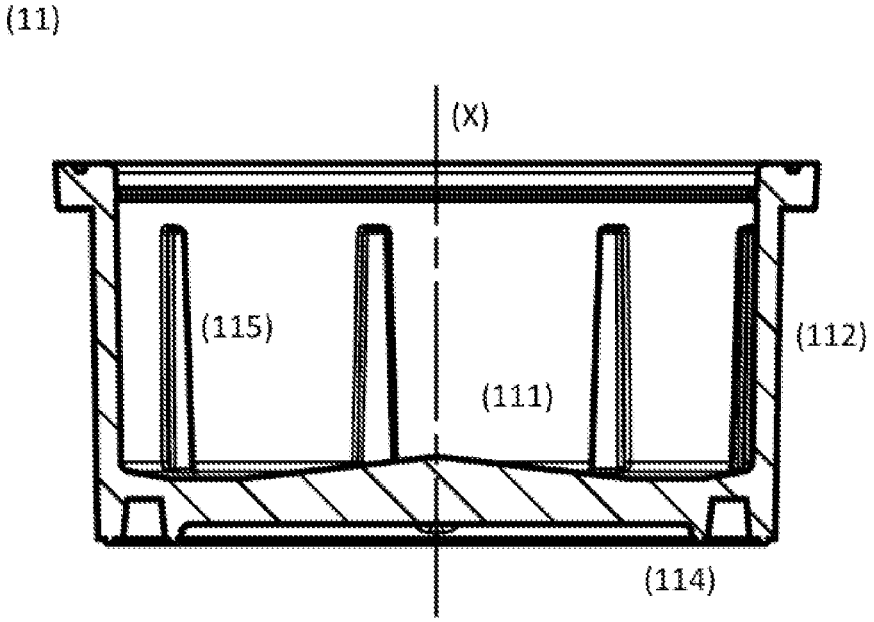
FIG. 11: side-cut view of an embodiment of a container part (11) of a capsule (1) according to the present invention.
Figure 12:
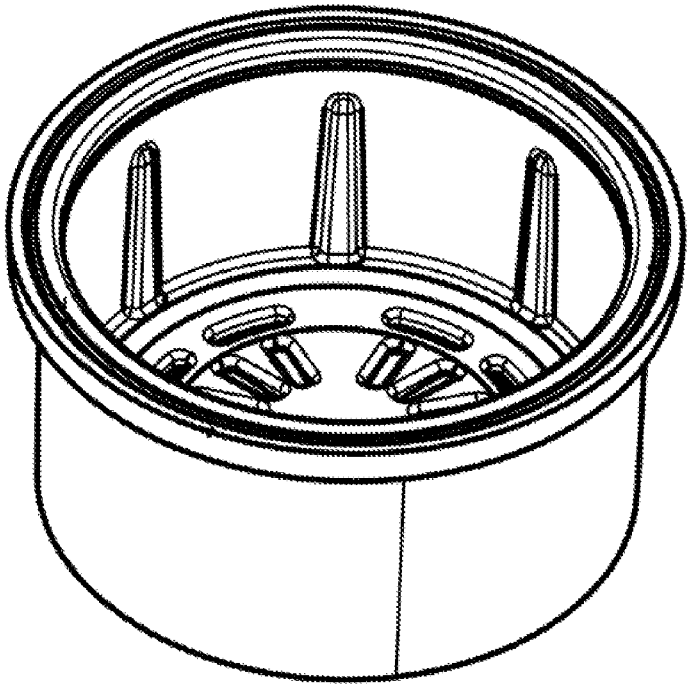
FIG. 12: top perspective view of an embodiment of a container part (11) of a capsule (1) according to the present invention.

According to another aspect of the present invention, schematically represented in FIGS. 7 to 10 and further in FIGS. 11 and 12, said capsule (1) can further present a plurality of flow passage zones (113) on said base wall (111), configured and disposed so as to balance the pressure forces exerted by the hydraulic flow upstream thereupon.

In particular, said base wall (111) can present a plurality of flow passage zones (113) provided with an elongated form, preferentially with a relation between length and width comprised between 2 and 10, particularly preferentially between 3 and 6, whereby part of said flow passage zones (1131) extends along an at least approximately radial direction radial, and at least part of the flow passage zones (1132) extends along a circular direction.

This particular configuration and disposition of the flow passage zones (113) advantageously provides a better distribution of the hydraulic pressure upstream upon the base wall (111), thereby contributing to improving the requirements thereof in terms of material quantity (i.e., wall thickness) and structural reinforcement, especially in the central region thereof.

It is preferred when said base wall (111) presents a plurality of flow passage zones (113) including first flow passage zones (1131) of radial orientation provided in a central region that presents a bigger wall thickness, and second flow passage zones (1132) of circular orientation provided on a peripheral region that presents smaller wall thickness, whereby said first and second flow passage zones (1131, 1132) presents characteristic dimensions, in particular length and width, at least approximately similar.

Moreover, said base wall (111) can present a plurality of first flow passage zones (1131) disposed along an at least approximately radial orientation provided on a central region of wall thickness bigger and/or increasing of said base wall (111).

Complementarily to the aforementioned aspect, said base wall (111) can present a plurality of second flow passage zones (1132) disposed along an at least approximately angular orientation angular provided on a peripheral region of wall thickness smaller and/or constant of said base wall (111).

In particular, said base wall (111) can comprise a plurality of regions adapted for flow passageway, whereby said regions for flow passageway (113) are provided as at least one of: openings and weakened material zones adapted so that break under the effect of the hydraulic pressure upstream thereof.

As referred, the capsule (1) according to the present invention is provided in a composite substance that comprises bio-polymers.

In particular, the capsule (1) can be produced by means of injection of said composite substance in moulds, at least of said container part (11), preferentially also of said lid part (12).

In particular, said composite substance can present a composition that includes natural fibres adapted so that provide dimensional and functional characteristics similar to those of said synthetic polymers, preferentially including natural fibres resulting from the processing of vegetable species, such as for example coffee, cinnamon, sugarcane, corn and cassava.

Moreover, it is particularly preferred when said natural fibres include at least one of, preferentially at least two of the list of natural fibres resulting from the processing of:

green coffee beans;

cinnamon;

sugarcane;

corn;

cassava.

According to a particularly preferred aspect, the capsule (1) according to the present invention is provided in a composite substance that presents a thermoplastic matrix reinforced with natural fibres, including coffee silverskin fibre, and whereby the polymeric matrix that groups the silverskin fibre comprises polymers of natural origin, including derivate of cellulose and aliphatic polyesters.

The invention claimed is:

1. A capsule for preparing edible products, said capsule comprising a container part and a lid part, the container part comprising a base wall and a sidewall extending with relation to a central axis, and being configured to resist interior pressures of at least 4 bar, the base wall being a beverage exit wall, the container part provided in a composite substance comprising a composition that includes biopolymers, wherein the base wall comprises a central region and an annular region peripheral and adjacent to the central region, the central region having a downstream-oriented face having a planar shape, the base wall comprises a wall thickness that increases in the direction of the central region, along at least part of a radial extension, whereby said increase of the wall thickness of the base wall is only provided in an upstream-oriented face thereof, and the downstream-oriented face retains a planar form devoid of projections, and whereby the central region of the base wall has a larger maximum wall thickness than a maximum wall thickness of the annular region, so that a greater structural resistance is provided at the central region of the base wall.

2. The capsule according to claim 1, wherein the base wall comprises a wall thickness with a ratio of a bigger wall thickness and a smaller wall thickness between 1.1 and 4, and the bigger wall thickness at least of the upstream-oriented face and at the central region has at least one of: a spot shape, a circular shape, a radial shape, and a ring shape.

3. The capsule according to claim 1, wherein said central region extends in the radial extension bigger than 0.2 times a characteristic dimension defined by the base wall.

4. The capsule according to claim 1, wherein the upstream-oriented face has a conic shape extending upstream, so that the increase of wall thickness is provided on said radial extension, with relation to a remaining radial extension on a periphery region, of the base wall.

5. The capsule according to claim 1, wherein the container part comprises lateral reinforcement ribs that extend in an inward face of a lateral wall along a prevailing flow direction and increase in thickness inwards and towards the base wall, said increase in thickness extends in at least one of a circular direction and a radial of said lateral reinforcement ribs, in relation to the central axis, and said increase in thickness extends continuously and at least inwards relative to an interior of the capsule.

6. The capsule according to claim 1, wherein the base wall comprises a plurality of flow passage zones provided with an elongated shape, whereby part of said flow passage zones extends along a direction at least approximately radial and along a circular direction.

7. The capsule according to claim 1, wherein the base wall comprises a plurality of flow passage zones including first flow passage zones of radial orientation provided on the central region, and second flow passage zones of circular orientation provided in the annular region, whereby said first and second flow passage zones are similar in size.

8. The capsule according to claim 1, wherein the base wall comprises a plurality of first flow passage zones disposed along an at least approximately radial orientation on the central region of the base wall, and the base wall comprises a plurality of second flow passage zones disposed along an at least approximately angular orientation on the annular region.

9. The capsule according to claim 1, wherein the base wall comprises a plurality of regions adapted for flow passage, whereby said plurality of regions are provided as at least one of: openings or weakened material zones configured to break under the effect of hydraulic pressure upstream thereof.

10. The capsule according to claim 1, wherein the composite substance comprises at least one natural fibre resulting from the processing of:

green coffee beans;

cinnamon;

sugar cane;

corn;

cassava.

11. The capsule according to claim 1, wherein the composite substance comprises a thermoplastic matrix reinforced with natural fibres, including coffee silverskin fibre, and a polymeric matrix that groups the silverskin fibre comprises polymers of natural origin, including derivatives of cellulose and aliphatic polyesters.

* * * * *